US007950965B2

(12) United States Patent
Cao et al.

(10) Patent No.: US 7,950,965 B2
(45) Date of Patent: May 31, 2011

(54) ELECTRICAL CONNECTOR HAVING PASSAGEWAYS PROTECTED FROM CONTAMINATION

(75) Inventors: Li Cao, Kunshan (CN); Chien-Jen Ting, Tu-Cheng (TW); Ming-Lun Kuo, Tu-Cheng (TW); Xiang-Qi Yang, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/783,579

(22) Filed: May 20, 2010

(65) Prior Publication Data

US 2010/0297885 A1 Nov. 25, 2010

(30) Foreign Application Priority Data

May 20, 2009 (CN) ..... 2009 2 0303345

(51) Int. Cl.
*H01R 24/00* (2011.01)

(52) U.S. Cl. ..... 439/660

(58) Field of Classification Search ..... 439/626, 439/374, 377, 79, 660, 733
See application file for complete search history.

(56) References Cited

U.S. PATENT DOCUMENTS

| | | | | |
|---|---|---|---|---|
| 6,319,017 | B1 * | 11/2001 | Kuo | 439/64 |
| 6,478,590 | B1 * | 11/2002 | Kuo | 439/159 |
| 6,736,651 | B2 * | 5/2004 | Ho | 439/79 |
| 6,887,112 | B2 | 5/2005 | Jae | |
| 7,217,159 | B2 * | 5/2007 | Chung | 439/607.01 |
| 7,758,355 | B2 * | 7/2010 | Higeta et al. | 439/79 |
| 7,824,192 | B2 * | 11/2010 | Lin et al. | 439/79 |
| 7,867,010 | B1 * | 1/2011 | Ting et al. | 439/353 |
| 2008/0254659 | A1 * | 10/2008 | Ting | 439/159 |
| 2010/0291799 | A1 * | 11/2010 | Ting et al. | 439/607.58 |

FOREIGN PATENT DOCUMENTS

JP 2586390 12/1998

* cited by examiner

*Primary Examiner* — Neil Abrams
*Assistant Examiner* — Phuong T Nguyen
(74) *Attorney, Agent, or Firm* — Andrew C. Cheng; Wei Te Chung; Ming Chieh Chang

(57) ABSTRACT

An electrical connector (100) includes an insulative housing (20) defining a plurality of passageways (20*a*) with an inserted opening (215), a plurality of forniciform terminals (30) inserted into the passageways (20*a*) from the inserted openings (215) and disposed therein, each defining a soldering portion (34) extending towards outside of the insulative housing (20) and a connecting portion (33) folding and extending from one end of soldering portion (34). Each of the connecting portions (33) covers the inserted opening (215), both cut sides (331) of which are pressed against by a pair of protecting protrusions (216) which integrally protrudes outwards from both sides of inserted opening (215) of the insulative housing (20).

18 Claims, 8 Drawing Sheets

ELECTRICAL CONNECTOR HAVING PASSAGEWAYS PROTECTED FROM CONTAMINATION

BACKGROUND OF THE INVENTION

1. Field of the Invention

The present invention relates to an electrical connector, and more particularly, to an electrical connector having terminal passages protected from contamination of debris.

2. Description of the Related Art

U.S. Pat. No. 6,887,112 issued to Kuroki et. al on May 3, 2005, discloses an electrical connector including a longitudinal insulative housing, a plurality of contacts received in the housing and arranged along a longitudinal direction of the housing and a shielding member covering on the insulative housing for preventing EMI (Electro Magnetic Interference). The housing is provided with a base portion, a mating portion extending forwardly from the base portion and defining a mating room. The mating portion defines a plurality of passageways extending outwards through the base portion and being in communicating with the mating room for receiving the contacts. Each of the contacts includes a retaining portion retained in the base portion, a soldering portion extending outwards from one end of the retaining portion, a forniciform contacting portion extending from the other end of the retaining portion and obliquely protruding into the mating portion for electrically connecting with a mating object.

Because the forniciform shaped configuration of the contacts are inserted into the passageway from a rear end of the base portion, in such a way that the passageway forms a larger inserted opening at the vicinity of the base portion for permitting the forniciform contacting portion being inserted therethrough. However, the passageways could be contaminated by some impurities such as the dust, or even bridged with each other by solder siphoning therein during the process of the contacts being soldered, as the larger inserted openings of the passageways are not protected after the contacts are disposed into the passageways. Especially, it will generate a short circuit between two adjacent contacts if the solder siphons into the passageways.

J.P. Pat. No. 2586390 issued to AMP Inc. on Dec. 2, 1998, also discloses an electrical connector similar to the above-mentioned connector. The electrical connector includes a plurality of forniciform contacts received and retained in an insulative housing. The insulative housing has a plurality of grooves with a larger opening for permitting the forniciform contacts inserted thereinto. In such a way that the opening is exposed and the solder easily siphon therein in procedure of soldering the tails of the contacts.

Therefore, an improved electrical connector is desired to overcome the disadvantages of the related arts.

SUMMARY OF THE INVENTION

An object of the present invention is to provide an electrical connector with a plurality of covered terminal grooves for dust-proof and protecting terminals therein from being bridged with each other during soldering process.

In order to achieve above-mentioned object, an electrical connector in accordance with a preferred embodiment of the present invention includes an insulative housing defining a plurality of passageways with an inserted opening, a plurality of forniciform terminals inserted into the passageways from the inserted openings and disposed therein, each defining a soldering portion extending towards outside of the insulative housing and a connecting portion folding and extending from one end of soldering portion. Each of the connecting portions covers the inserted opening, both cut sides of which are pressed against by a pair of protecting protrusions which integrally protrudes outwards from both sides of inserted opening of the insulative housing.

Other objects, advantages and novel features of the invention will become more apparent from the following detailed description of the present embodiment when taken in conjunction with the accompanying drawings.

DETAILED DESCRIPTION OF THE INVENTION

Figure 1:
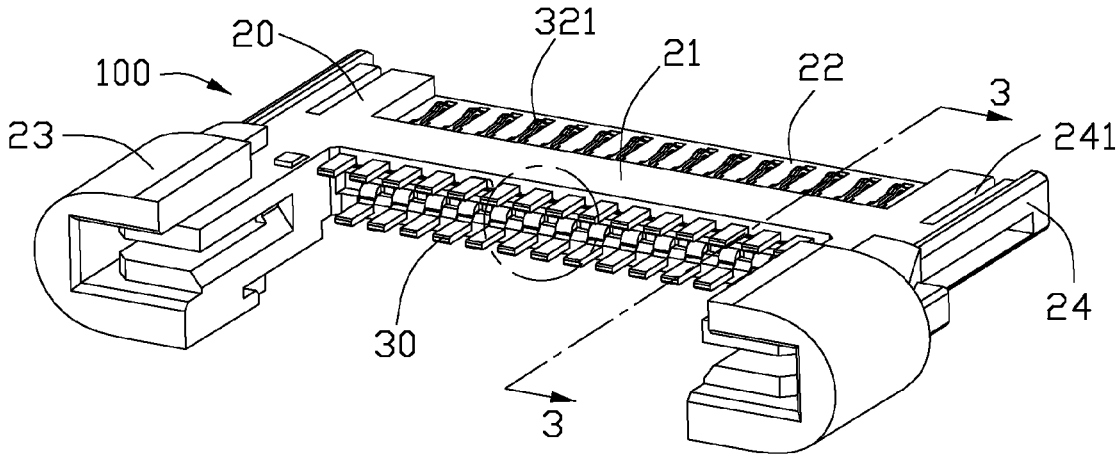
FIG. 1 is a perspective view of an electrical connector in accordance with the preferred embodiment of the present invention.

Reference will now be made to the drawing figures to describe the preferred embodiment of the present invention in detail.

Figure 2:
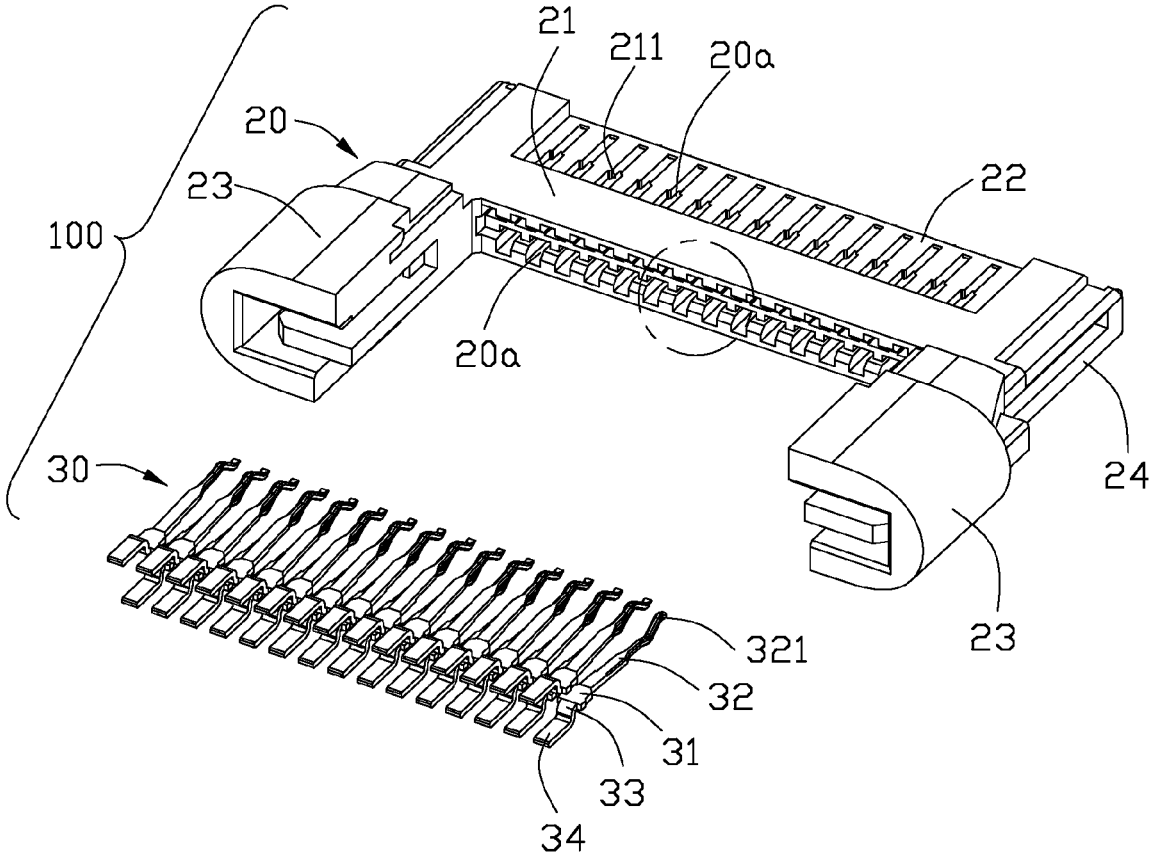
FIG. 2 is an exploded perspective view of the electrical connector of FIG. 1.
Figure 3:
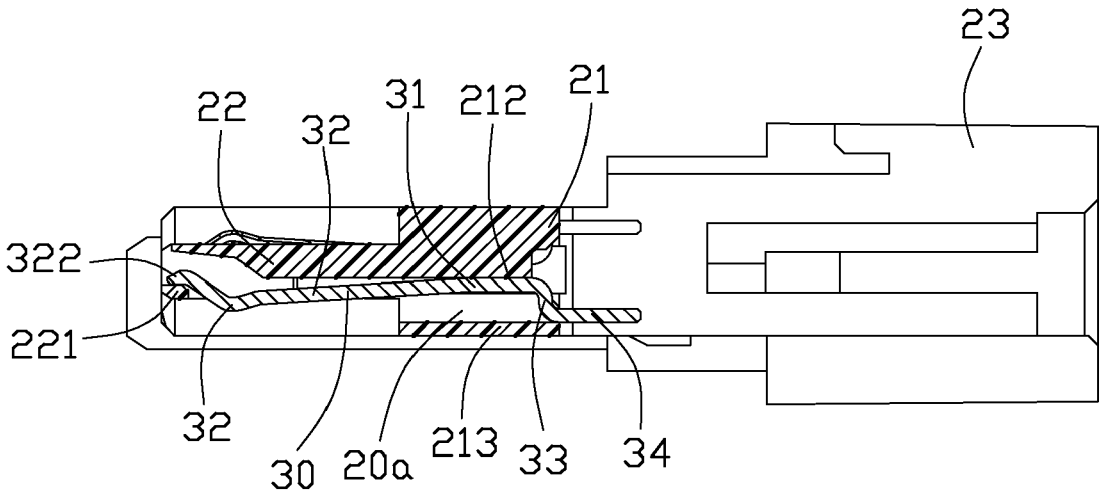
FIG. 3 a cross-section view of the electrical connector taken along line 3-3 of FIG. 1.

Referring to FIGS. 1 to 3, an electrical connector 100 includes an insulative housing 20 defining a plurality of passageways 20*a* and a plurality of forniciform terminals 30 positioned in the passageways 20*a*. The terminal 30 is formed by an entire metal carrier processed by means of cut and folded.

The insulative housing 20 has a longitudinal base portion 21, a mating portion 22 extending from the base portion 21 in a first direction, and a pair of mounting portions 23 extending from the base portion 21 in a second direction opposite to the first direction for being assembled with a PCB (not shown). The passageways 20*a* extend rearwards through the base portion 21 along the second direction and extend forwards into the mating portion 22 along the first direction. The passageways 20*a* disposed at the mating portion 22 are regarded as a contacting area of the mating portion 22. Moreover, the mating portion 22 has a pair of alignment areas 24 integrally connecting with both sides of the contacting area and defining a guiding slit 241 concaved inwards at one side thereof for anti-mismatching with a mating connector (not shown).

Figure 4:
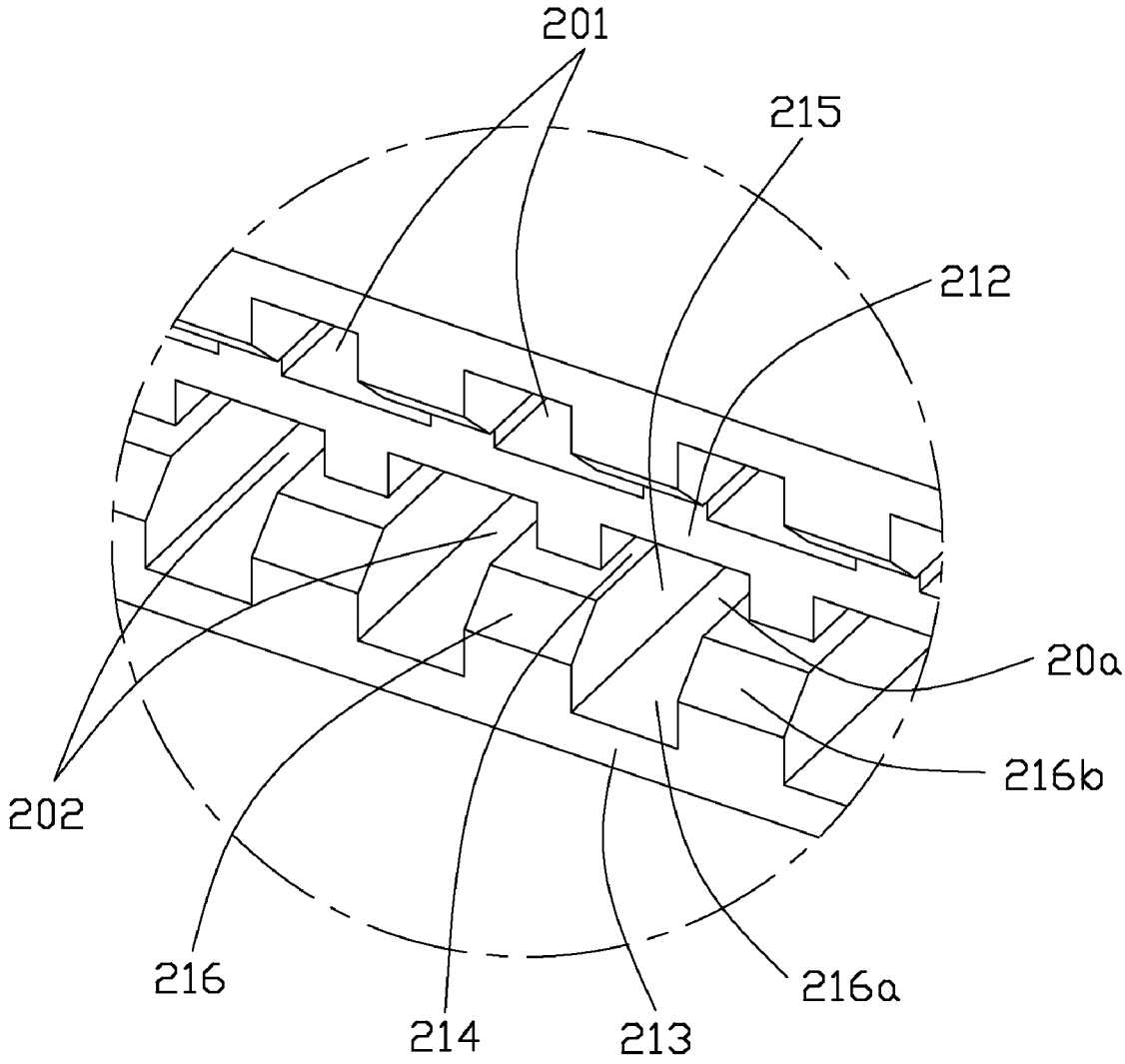
FIG. 4 is a partial enlarged view of an insulative housing in the FIG. 2.
Figure 5:
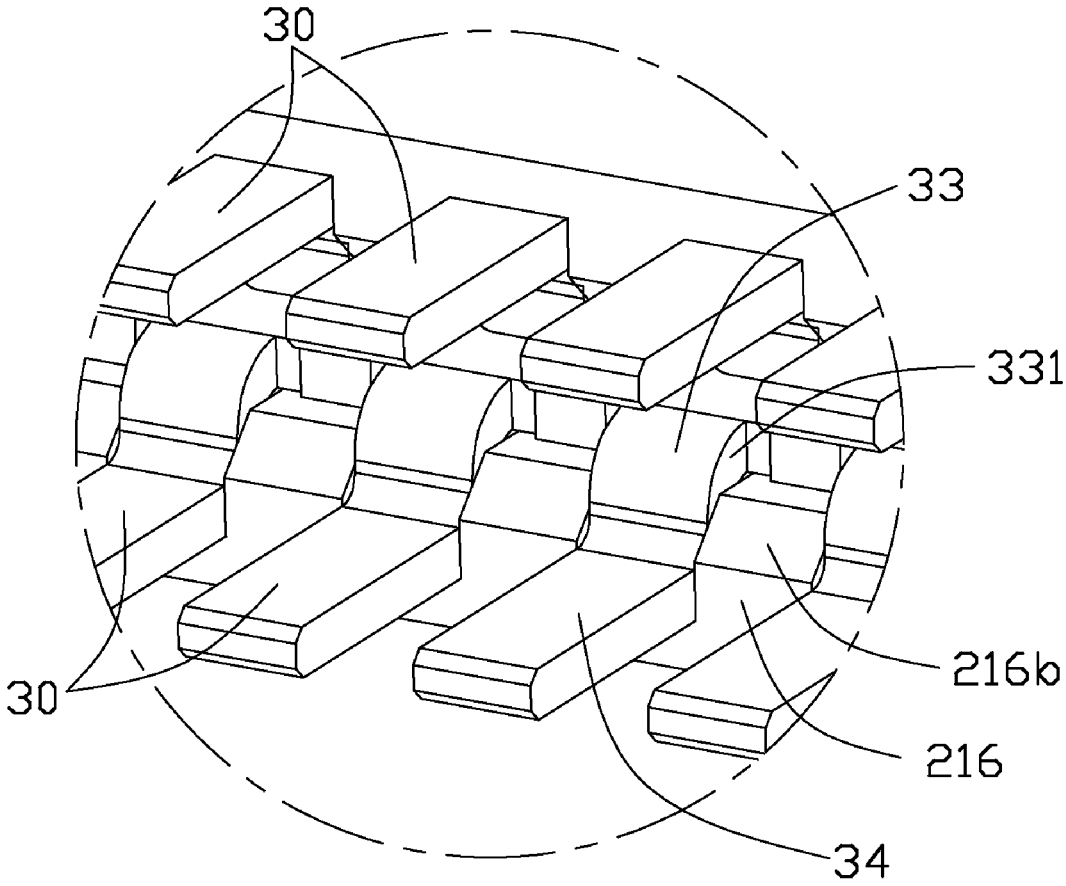
FIG. 5 is a partial enlarged view of the electrical connector of FIG. 1.
Figure 6:
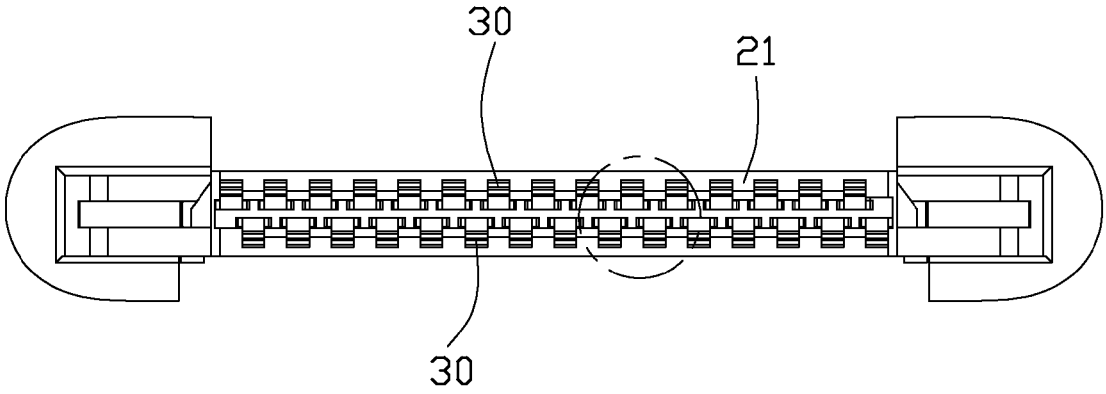
FIG. 6 is a rear elevational view of the electrical connector of FIG. 1.
Figure 7:
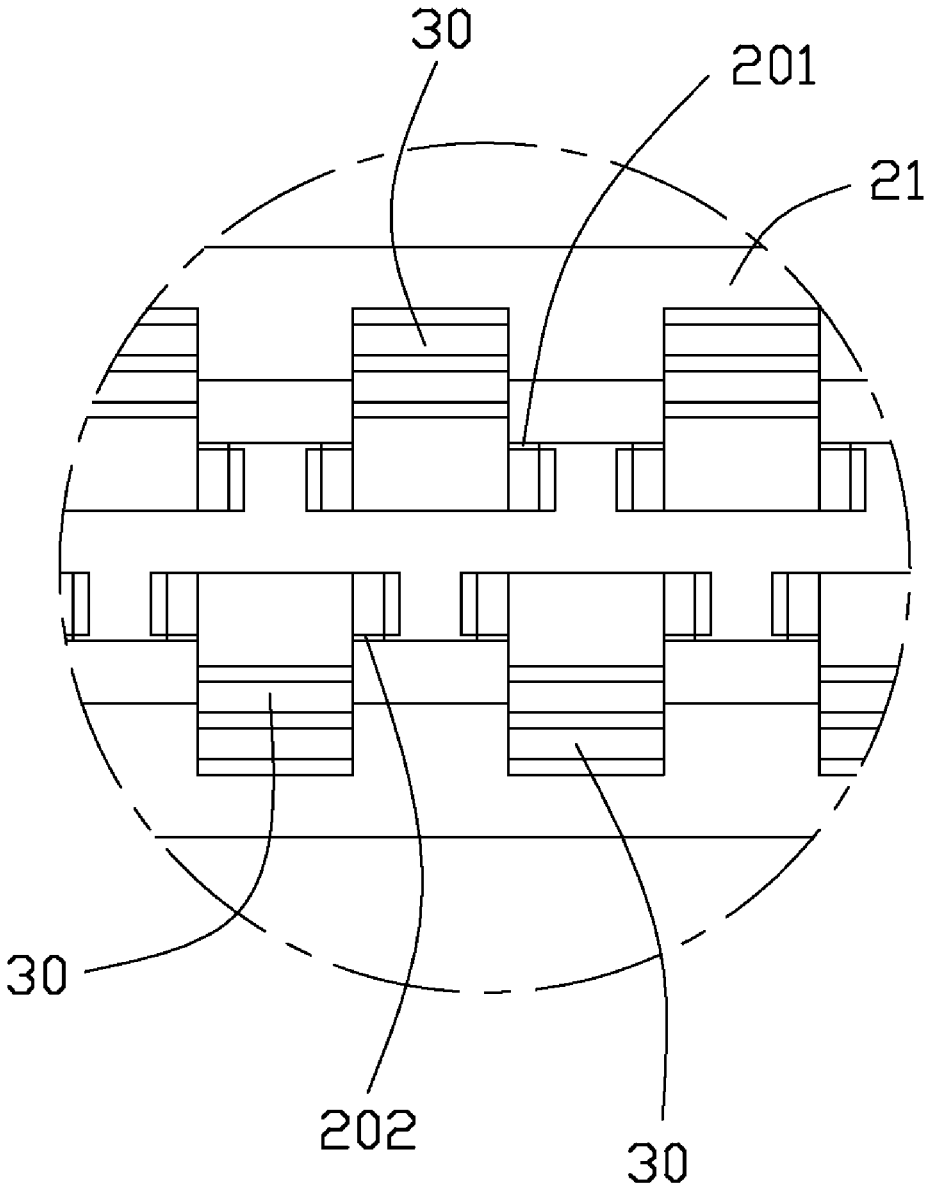
FIG. 7 is a partial enlarged view of the electrical connector of FIG. 6.

Referring to FIGS. 3, 4 and 5, the passageways 20*a* respectively run through both side surfaces of the mating portion 22. The passageways 20*a* include a plurality of top passageways 201 and a plurality of bottom passageways 202 opposite to the top passageways 201 in a rear view, thereby being arranged in two rows. The terminals 30 are respectively disposed into the top passageways 201 and the bottom passageway 202. Furthermore, in a top view the terminals 30 in the top passageways 201 and the terminals 30 in the bottom passageway 202 are staggered with each other (as best seen from the FIGS. 6 and 7).

Figure 8:
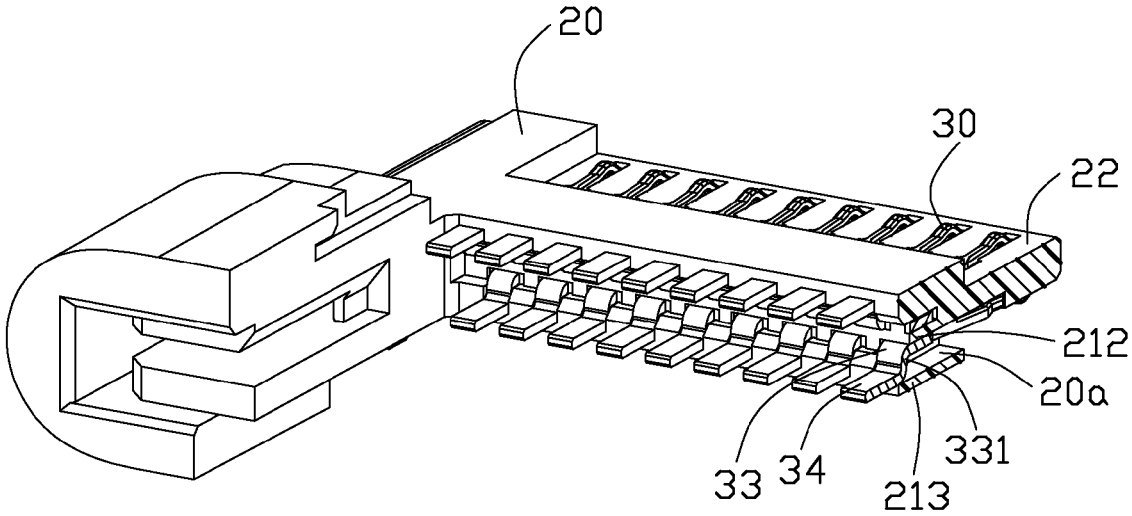
FIG. 8 is a cross-section view of the electrical connector taken along a side inner wall of a terminal passageway.

Referring to FIGS. 3, 4 and 8, the passageway 20*a* of the base portion 21 includes a top inner wall 212, a bottom inner wall 213 and two side inner walls 214, thereby forming an inserted opening 215 at a rear side of the base portion 21 for terminals 30. The terminals 30 are forwardly inserted into the passageways 20*a* from the inserted openings 215 and disposed therein. Cooperation with FIG. 2, each of the terminals 30 includes a retaining portion 31 retained in the insulative housing 20, a forniciform contacting arm 32 extending towards the mating portion 22 from one end of the retaining portion 31, a connecting portion 33 folding and extending from the other end of the retaining portion 31, and a soldering portion 34 extending towards outside of the insulative housing for being soldered onto the PCB. The contacting arm 32 has a contacting portion 321 protruding outwards from the passageway 20*a* for electrically connecting with the mating connector. The mating portion 22 defines a blocking portion 221 pressing against a free end 322 of the contacting arm 32 for preventing the contacting arm 32 from moving outwards and positioning it within the passageway 20*a*.

Referring to FIGS. 3, 5 and 8, the connecting portion 33 of the terminal 30 connects with the retaining portion 31 and the soldering portion 34 together as a vertical-shaped configuration. Especially, a top end and a bottom end of the connecting portion 33 respectively presses against the top inner wall 212 and the bottom inner wall 213 of the passageway 20*a*, therefore the connecting portion 33 covers the inserted opening 215. Moreover, a pair of cut sides 331 of the connecting portion 33 are pressed against by a pair of protecting protrusions 216 which integrally protrude outwards from the side inner wall 214 disposed at both sides of inserted opening 215, i.e. the two protecting protrusions 216 form a protecting recess 216*a* in communicating with of the passageway 20*a* for receiving and shielding the connecting portion 33 therein. In such a manner that the connecting portion 33 and the protecting protrusions 216 forms a protecting structure blocking the inserted opening 215 for dust-proof, or even for preventing the passageway 20*a* from being contaminated by solder siphoning therein during soldering process of the soldering portion 34 soldered onto the PCB. Therefore, said protecting structure could especially protect the terminals 30 from being bridged with each other.

Referring to FIG. 5, the soldering portion 34 of the terminal 30 is sandwiched between the two adjacent side inner walls 214, i.e. blocked between the two protecting protrusions 216 for preventing a solder from siphoning into the passageway 20*a*. The protecting protrusion 216 defines a guiding surface 216*b* for guiding the terminal 30 inserted into the passageway 20*a* of the insulative housing 20.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the board general meaning of the terms in which the appended claims are expressed.

What is claimed is:

1. An electrical connector comprising:

an insulative housing comprising a plurality of passageways, each with an inserted opening;

a plurality of forniciform terminals inserted into the passageways from the inserted openings and disposed therein, each defining a soldering portion extending towards outside of the insulative housing and a connecting portion folding and extending from one end of soldering portion; and wherein each of the connecting portions covers the inserted opening, both cut sides of which are pressed against by a pair of protecting protrusions which integrally protrudes outwards from both sides of inserted opening of the insulative housing;

the soldering portion of the contact is sandwiched between the two protecting protrusions;

two protecting protrusions form a protecting recess in communicating with of the passageway for receiving the connecting portion therein;

the protecting protrusion comprises a guiding surface for guiding the contact inserted into the passageway of the insulative housing.

2. The electrical connector as described in claim 1, wherein the soldering portion of the contact is soldered on the PCB.

3. The electrical connector as described in claim 2, wherein; the mating portion defines a blocking portion pressing against a free end of the contacting arm for preventing the contacting arm from moving outwards and positioning it within the passageway.

4. The electrical connector as described in claim 3, wherein; the connecting portion and the protecting protrusions forms a protecting structure blocking the inserted opening for dust-proof.

5. The electrical connector as described in claim 3, wherein the contact comprises a retaining portion retained in the insulative housing in such a way that said connecting portion connects with the retaining portion and the soldering portion together.

6. The electrical connector as described in claim 5, wherein the contacts are arranged in two rows, respectively disposed in a plurality of top passageways and a plurality of bottom passageways opposite to the top passageways, in a top view the contacts in the top passageways and the contacts in the bottom passageways are staggered with each other.

7. The electrical connector as described in claim 3, wherein the insulative housing comprises a base portion, a mating portion extending from the base portion in a first direction, and a pair of mounting portions extending from the base portion in a second direction opposite to the first direction.

8. The electrical connector as described in claim 7, wherein the passageways extend rearwards through the base portion along the second direction and extend forwards into the mating portion along the first direction.

9. The electrical connector as described in claim 8, wherein the mating portion comprises a contacting area formed by the passageways and an alignment area integrally connecting with both ends of the contacting area and defining a slit concaved inwards for anti-mismatch.

10. An interconnecting system comprising:

an insulative housing comprising a plurality of contact receiving passageways, each with an inserted opening;

a plurality of terminals inserted into the passageways from the inserted opening, each terminal defining a forniciform contacting portion within the passageway, a connecting portion and a soldering portion both exposed outside of the passageway; and wherein the passageway comprises a top inner wall, a bottom inner wall and two side inner walls pressing against the connecting portion of the contact, thereby forming a protecting recess for receiving the connecting portion;

wherein the connecting portions covers the inserted opening, both cut sides of which are pressed against by a pair of protecting protrusions which integrally protrudes outwards from both sides of inserted opening of the insulative housing;

the soldering portion of the contact is sandwiched between the two protecting protrusions;

the protecting protrusion comprises a guiding surface for guiding the contact inserted into the passageway of the insulative housing.

11. The interconnecting system as described in claim 10, wherein the terminal comprises a retaining portion retained in the insulative housing and bridging the contacting portion and the connecting portion together.

12. The interconnecting system as described in claim 10, wherein; the connecting portion and the protecting protrusions forms a protecting structure blocking the inserted opening for preventing the passageway from being contaminated by solder siphoning therein during soldering process of the soldering portion.

13. An electrical connector comprising: an insulative housing defining a plurality of passageways extending along a front-to-back direction and through a rear face of the housing, each of said passageways essentially formed by opposite first and second side walls in a transverse direction, and opposite third and fourth side walls in a vertical direction perpendicular to said transverse direction, each of the passageways forming an inserted opening around the rear face;

a plurality of contacts disposed in the corresponding passageways, respectively, each of said contacts defining a retention section intimately secured to the first side wall, a resilient contacting section extending from a front end of the retention section forwardly in an oblique direction toward the second side wall, a connection section extending from a rear end of the retention section and toward and beyond the second side wall so as to essentially forwardly shield the passageway from an exterior, and a tail section extending from the connection section for mounting to an external electronic component; wherein the housing defines a plurality of protection recesses each formed between two protecting protrusions around the rear face to hold the corresponding connection sections therein, respectively, wherein each of the connecting portions covers the inserted opening, both cut sides of which are pressed against by the corresponding pair of protecting protrusions which integrally protrudes outwards from both sides of inserted opening of the insulative housing;

the protecting protrusion comprises a guiding surface for guiding the contact inserted into the passageway of the insulative housing.

14. The electrical connector as claimed in claim 13, wherein the retention section defines barbs on two lateral sides extending beyond the correspond third and fourth side walls for piercing into the housing for retention.

15. The electrical connector as claimed in clam 13, wherein said tail section extends rearwardly from the corresponding passageway.

16. The electrical connector as claimed in claim 13, wherein the second side wall extends rearwardly further than the first side wall.

17. The electrical connector as claimed in claim 13, wherein said connection section is essentially directly exposed to the exterior.

18. The electrical connector as claimed in claim 17, wherein a lateral dimension of said connection section in the transverse direction is essentially not less than a distance between said third and fourth side walls.

* * * * *